United States Patent [19]

Lozano

[11] Patent Number: 4,854,622

[45] Date of Patent: Aug. 8, 1989

[54] DOOR ASSEMBLY INCORPORATING MEANS TO INCREASE RESISTANCE TO FORCED ENTRY

[76] Inventor: Anthony R. Lozano, 3139 Loma Verde Dr., Unit #38, San Jose, Calif. 95117

[21] Appl. No.: 226,514

[22] Filed: Jul. 29, 1988

Related U.S. Application Data

[63] Continuation of Ser. No. 706,350, Feb. 27, 1985, abandoned.

[51] Int. Cl.[4] ..... E05C 1/16

[52] U.S. Cl. ..... 292/340; 292/337; 16/382

[58] Field of Search ..... 292/337, 340, 251; 70/450, 451, 416, 417, 418; 16/382, 384; 49/381, 394, 501, 503

[56] References Cited

U.S. PATENT DOCUMENTS

| | | | |
|---|---|---|---|
| 1,231,556 | 7/1917 | Bauer | 16/384 |
| 1,574,493 | 2/1926 | Leonard | 70/451 |
| 2,785,565 | 3/1957 | Schlage | 70/451 |
| 2,921,461 | 1/1960 | Schlage | 292/337 X |
| 3,231,928 | 2/1966 | Grunert | 16/382 X |
| 3,815,945 | 6/1974 | Lamphere | 292/340 |
| 4,065,162 | 12/1977 | Schlage | 292/340 |
| 4,118,827 | 10/1978 | Yamamoto | 49/381 X |
| 4,397,168 | 8/1983 | Rotondi et al. | 70/417 |

FOREIGN PATENT DOCUMENTS

| | | | |
|---|---|---|---|
| 6060720 | 12/1934 | Fed. Rep. of Germany | 70/451 |
| 1144150 | 2/1963 | Fed. Rep. of Germany | 292/340 |
| 2457363 | 1/1981 | France | 292/340 |

*Primary Examiner*—Richard E. Moore

*Attorney, Agent, or Firm*—John J. Leavitt; George M. Cooper

[57] ABSTRACT

One of the most popular ways of gaining access to a locked premise is through forced entry of a door assembly. Presented is a door assembly incorporating a system of components cooperating with a door assembly to increase resistance to forced entry through such door assembly. Forced entry is generally defined as being an unauthorized entry accomplished by the use of force upon the physical components of the premises. Such forced entry usually takes the form of battering on the door adjacent to the door lock assembly, or adjacent to the center hinge of the door. Presented is a door assembly incorporating a reinforcement plate for the door lock assembly, a strike plate of novel design cooperating with the door assembly to strengthen the union between the door lock assembly and the lock jamb of the door frame, and a reinforcement plate associated with one or all of the hinges to reinforce the union between the hinges and the hinge jamb. In one aspect, the invention includes materially heavier components that are capable of resisting breaking or bending as by a pry tool, and in another aspect, includes the use of extraordinarily long screw fasteners driven through the reinforced plates at an angle so that any attempted forced entry through the door requires that the elongated screw fasteners be stripped from the wall structure before forced entry can be accomplished.

14 Claims, 4 Drawing Sheets

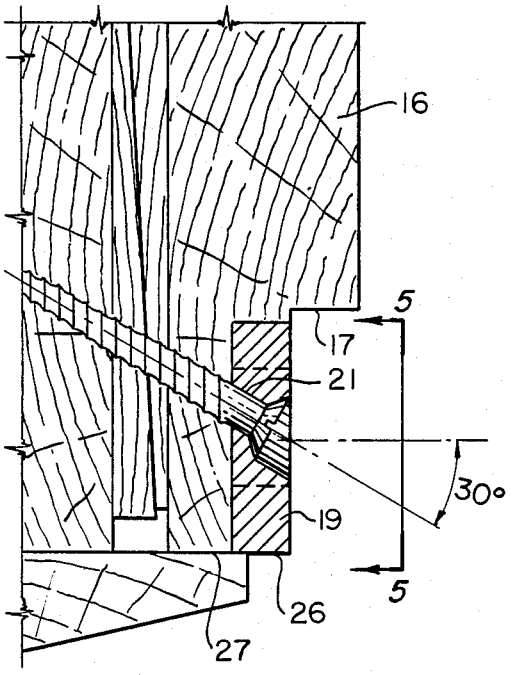
FIG. 3
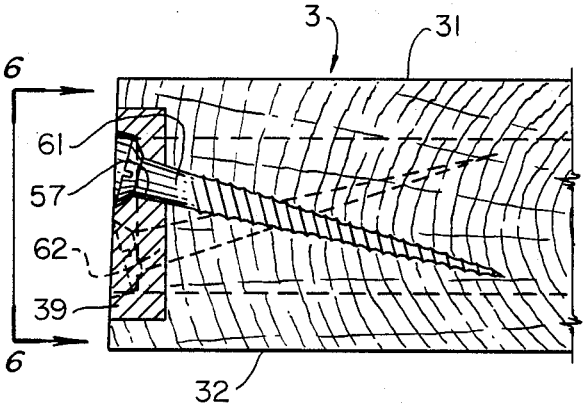
FIG. 4
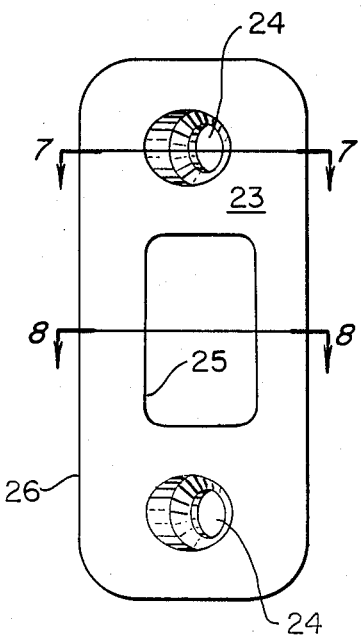
FIG. 5
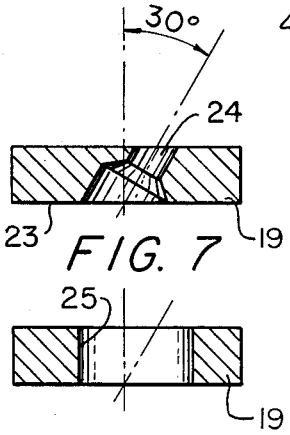
FIG. 7
FIG. 8
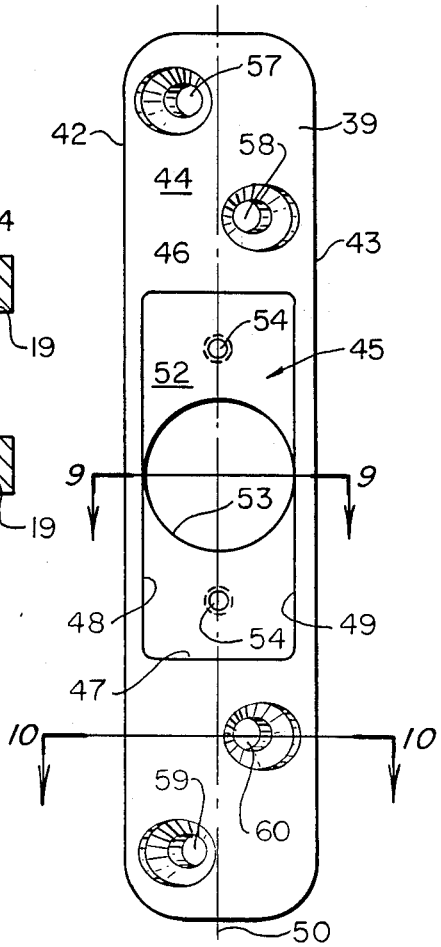
FIG. 6

DOOR ASSEMBLY INCORPORATING MEANS TO INCREASE RESISTANCE TO FORCED ENTRY

This application is a continuation of application Ser. No. 706,350, filed Feb. 27, 1985 now abandoned.

BACKGROUND OF THE INVENTION

1. Field of the Invention

This invention relates to door assemblies, and particularly to solid stile and rail doors and solid core wood doors used as a component in a door assembly including door frame, adjacent wall support members to which the door frame is attached, hinges for pivotally mounting the door on the door frame, and a lock assembly including a lock device mounted on the door and cooperating with a strike plate mounted in the door frame.

2. Description of the Prior Art

It is believed that the prior art relating to this invention resides in Class 292. A search of this class has revealed the existance of the following U.S. Pat. Nos. 1,688,626; 1,762,326; 1,924,806; 3,152,825; 3,159,416; and 4,065,162.

It is not generally known that a burglar can break into most homes with just one swift kick. In most instances, such kicks are delivered to the door adjacent the lock assembly. Since most doors are not constructed to withstand such force, the lock or the door or the lock jamb split and break apart and thus give access to the premises. Accordingly, it is one of the objects of this invention to provide a door assembly reinforced in such a way that it resists forced entry by this modus operandi.

In a special report dated October 1984, Consumer Reports states that more than 5 million homes will be burglarized in the United States, with something like 4 billion dollars worth of property stolen. Continuing, the report points out that many insurance companies offer discounts on homeowner's insurance policies according to which measures are taken to minimize the likelihood of a home being burglarized.

Statistics collected from the San Jose, Calif. Police Department, San Jose, Calif. being a city of approximately 650,000 people, indicate that the most likely month that a home will be burglarized is January, the most likely day of the week for burglaries is Friday, and the most likely four hour block of time is between 12 noon and 4 o'clock in the afternoon. From these statistics, it is apparent that window entry occurred in 45.4% of the entries, while door entry occurred in 38.3% of the entries. The location of the point of entry that appears to be most prevalent is the rear of the house, at 37.3% of the entries, with the front of the house accounting for 31.3% of the entries, and the side of the house accounting for 21.6% of the entries. Entries related specifically to doors, either front door or rear door, amounted to 17.7% for the front door, and 13.8% for a rear door.

From these figures, it is apparent that burglarizing of residences, whether they be homes, apartments, mobile homes, condominiums, duplexes or other types of premises, is very prevalent at least in San Jose, Calif., and from these figures it is presumed that such forced entries are just as prevalent in other comparable metropolitan areas. In the San Jose area, 72.6% of the entries occurred in houses. Only 14.3% occurred in apartments, with the remainder of the entries being spread between the other types of premises.

There are three general areas that may be pinpointed as weaknesses in a door assembly. One such area is the door frame at the lock point. Most conventional door frames are prefabricated in mills from various softwoods. Such softwoods are susceptible of bending and splitting and do not provide a very secure structure to which to fasten the door hardware. For instance, the conventional strike plate used on most conventional door assemblies constitutes nothing more than a flat plate rarely more than 1/16" in thickness, and having a large aperture to receive the door latch or dead bolt. This flat plate is most usually recessed into the softwood lock jamb of the frame no more than the thickness of the plate, and is secured in position by two relatively short, approximately ½" wood screws. Because in most instances the strike plate is attached to the lock jamb adjacent the inside edge of the jamb, one strong kick on the door adjacent the lock assembly, can easily split the wood from which the lock jamb is formed, or strip the thin metal plate and the screws from the softwood lock jamb. Accordingly, it is an important object of this invention to provide a system of hardware for a door assembly that resists forced entry by the imposition of kicks or other methods of battering to gain unauthorized entry.

The strike plate of most conventional door assemblies is recessed into the softwood lock jamb of the door frame, such strike plates nominally being approximately 1/16" in thickness. Accordingly, another object of the present invention is to replace such conventional relatively thin and fragile strike plates with a much thicker strike plate that is mortised into the lock jamb and secured not only to the lock jamb but also to the wall support members to which the door frame is attached.

Still another object of the invention in connection with the application of a reinforced strike plate is the provision of elongated screw fasteners to support the strike plate, the screw fasteners being driven into and through the lock jamb and into the wall support members behind the lock jamb at an angle other than 90°, and preferably in a direction that will tend to impose a tensile screw extraction force on the screws when unauthorized entry force is applied to the strike plate rather than a shearing force as with conventional strike plates.

A second area of weakness is the lock assembly of a conventional door. It is usually fitted to the door in a lock bore or hole that is bored in the door stile from one face through the other along an axis that is spaced approximately 2⅜" from the edge of the door. Bored into the edge of the door so that it extends diametrically of the lock bore is the latch bore which is approximately ⅞" in diameter. It will thus be seen that the door edge portion that lies immediately adjacent the lock bore and the bolt or latch bore constitutes an extremely weak area in the door itself and is usually not strengthened materially by the usually thin and fragile face plate that is recessed into the edge of the door, and which provides an aperture for slidable bearing of the latch or bolt as it moves from an unlocked to a locked position. Accordingly, another object of the present invention is to provide a reinforcement plate adapted to be mortised into the door edge and having a thickness at least three times the thickness of the face plate, with the face plate being secured to this much heavier and longer reinforcement plate by use of machine screws.

Another object of the invention is to provide a reinforcement plate for the face plate of a door lock assembly which is secured to the door stile by extraordinarily long screw fasteners that extend into the door stile at angles other than 90° to the face plate so as to reinforce the door stile against splitting.

The area of the door assembly immediately surrounding conventional hinge installations is the third weak area and is susceptible to intrusion by strong kicks. The reason for this is that most conventional hinge jambs are constructed from softwood, and the wood screws that are utilized to attach the hinge leafs to the door and to the hinge jamb are relatively short, and penetrate only the softwood frame member from which the jamb is constructed. Accordingly, another object of the invention is the provision of means associated with one or more of the hinges, that will resist forces imposed on the door that would tend to split the frame or to bend or shear the screws with which the hinges are attached to the hinge jamb.

In connection with the reinforcement of the hinge area, a more specific object of this invention is the placement of a reinforcement plate motised into the surface of the hinge jamb, underlying the associated leaf of the hinge and independently secured to the underlying hinge jamb and to the wall support member behind the hinge jamb by an elongated wood screw that penetrates these structural members at an angle other than 90°, with the associated leaf of the hinge being detachably secured to the reinforcement member by means of a machine screw.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In term of broad inclusion, the invention in one aspect comprises a complete door assembly which for purposes of definition may be defined as a unit composed of a group of parts or components which make up a closure for a passageway through a wall. For the purposes of this description, a door assembly comprises a door, hinges for mounting the door on a door frame, a locking device or devices, operation contacts such as handles, knobs, push plates, miscellaneous hardware and closures, the frame on which the door is hung, including the head frame member, the hinge jamb and the lock jamb, these latter frame members being anchored to surrounding wall support members including a wall header associated with the head frame member and vertical wall support members defining the opening in which the door frame is fitted. These vertical wall members frequently constitute 2"×4" studs doubled to provide a nominal 4"×4" built-up wall member joined to other structural wall members by the header and top and bottom plates. In this aspect of the invention, the improvement resides in the reinforcement of the lock assembly by the mortising of the door edge and the placement of a ⅜" thick plate in the door edge, secured by elongated screw fasteners that penetrate the door stile at angles other than 90°, the reinforcement plate having a recessed area within which is nested the face plate of the lock assembly, which is attached to the reinforcement plate by appropriate machine screws. Also included in this aspect of the invention is a reinforced strike plate that is also mortised into the lock jamb of the frame and secured to the lock jamb and to the underlying wall support members by elongated screw fasteners that penetrate both the lock jamb and the underlying wall support members at an angle other than 90°. Thirdly, the door assembly of the invention considered in this aspect includes reinforcement means associated with one or more of the hinges, which reinforcement means lies recessed in the hinge jamb, independently attached to the hinge jamb and to the structural wall support members supporting the hinge jamb, and to which reinforcement means the associated hinge leaf may be attached by a machine screw.

In another aspect, the invention includes a reinforcement plate as an article of manufacture for strengthening the door edge associated with the lock assembly, a reinforced strike plate for reinforcing the union between the lock jamb and the door assembly, and a reinforcement member associated with one or more of the hinges and the associated hinge jamb, to prevent entry through the door by destruction of the union between a hinge or hinges and the associated hinge jamb.

BRIEF DESCRIPTION OF THE DRAWINGS

FIG. 3 is a fragmentary horizontal sectional view in enlarged scale taken in the plane indicated by the line 3—3 in FIG. 2.

FIG. 4 is a fragmentary horizontal sectional view in enlarged scale taken in the plane indicated by the line 4—4 in FIG. 2.

FIG. 5 is a front elevational view of one form of strike plate adapted for use with a dead bolt lock.

FIG. 6 is a front elevational view of the reinforcement plate adapted to be mortised into the edge of the door and on which the face plate of the lock assembly is secured through use of machine screws.

FIG. 7 is a horizontal sectional view taken in the plane indicated by the line 7—7 in FIG. 5.

FIG. 8 is a horizontal sectional view taken in the plane indicated by the line 8—8 in FIG. 5.

DESCRIPTION OF THE PREFERRED EMBODIMENTS

Figure 11:
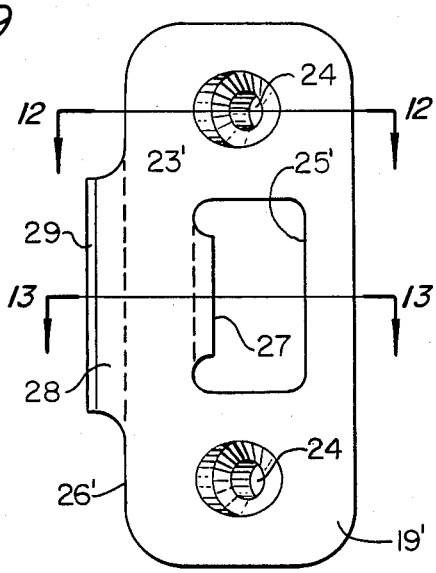
FIG. 11 is a front elevational view of another embodiment of a reinforced strike plate adapted to be mortised and recessed into a lock jamb and particularly useful in conjunction with a spring-loaded latch bolt.
Figure 13:
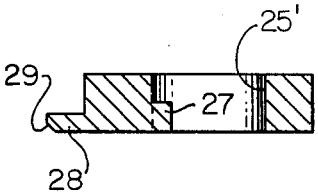
FIG. 13 is a horizontal sectional view taken in the plane indicated by the line 13—13 in FIG. 11.
Figure 19:
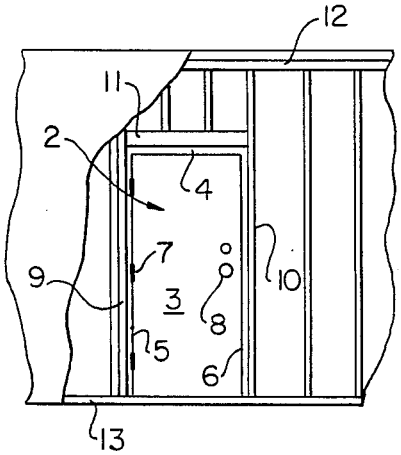
FIG. 19 is an elevational view of a complete door assembly, portions of the wall being broken away to reveal underlying structure.

In terms of greater detail, the door assembly, and the means for reinforcing a door assembly, comprise a door assembly as designated generally by the numeral 2 in FIG. 19, the door assembly including the door 3, a door frame comprising a header 4, a hinge jamb 5, a lock jamb 6, hinges 7, and a lock assembly designated generally by the numeral 8 and including the strike plate illustrated in FIGS. 5 or 11, which conventionally form a part of a door assembly. Also included in the definition of a door assembly are the vertical support members 9 to which the hinge jamb 5 is secured, the vertical support members 10 to which the lock jamb 6 is attached, and a header 11 to which the header frame member 4 is attached. It will of course be understood that when the wall is erected, the wall support members 9 and 10 are plumbed with respect to the top plates 12 and the bottom plate 13.

Figure 1:
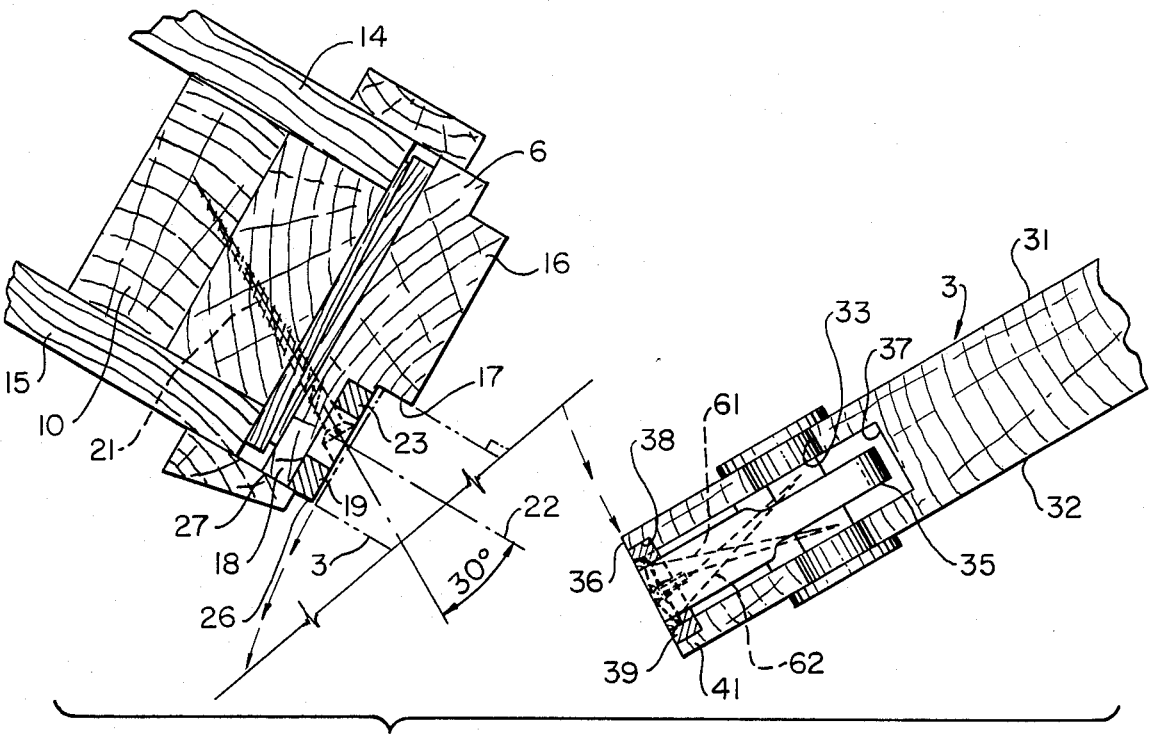
FIG. 1 is a composite fragmentary sectional view in plan, showing the relationship of an improved door assembly including the lock assembly and strike plate assembly.

Referring to FIG. 1, it will there be seen that the fragmentary portion of the door assembly illustrated includes the wall support members 10, to which is attached the outer siding member 14 and the inner wall surface material 15. The outer siding 14 may be fabricated from lumber, or it may be metal panels securely attached to the studs 9 and 10 as illustrated. In like manner, the wall covering 15 may be wood paneling or, more conventionally, may be plaster or sheet rock, so called "dry wall" construction.

Securely fastened to the vertical support members 10, which in home construction conventionally comprise a pair of 2"×4" studs nailed face-to-face as illustrated, is the lock jamb 6 which in this instance is provided with an integral door stop 16 having a shoulder 17 against which the door 3 abuts when closed, the shoulder 17 being formed by a relatively wide rabbet formed in the surface of the jamb 6.

Mortised into the rabbetted edge portion 18 of the jamb 6, is a strike plate or lock plate 19 which is nested in the jamb 6 in an appropriately routed recess formed therein. The plate 19 is securely fastened to both the jamb 6 and to the vertical support members 10 by a pair of elongated screw fasteners 21 which, as illustrated in FIG. 1, penetrate the strike plate 19, the jamb 6 and the vertical support members 10 at an angle other than 90°. I have found that a convenient angle is 30° from a plane 22 perpendicular to the face 23 of the strike plate 19. The strike plate 19 is of course provided adjacent opposite ends with a pair of bores 24 that pass through the thickness of the plate at an angle of 30° to the plane 22 to accommodate the screw fasteners 21. Additionally, the strike plate 19 is provided with a generally symmetrically centered aperture 25 dimensioned to snugly receive the lock bolt or spring latch of the lock mechanism or lock assembly 8 mounted in the door 3. To accommodate the kinds of pressures that a sharp or strong kick or other battering force might impose on the strike plate 19, the strike plate is preferably formed from metal and is approximately ⅜" thick and possesses a width of approximately 47% of the length of the strike plate.

In the embodiment of the invention illustrated in FIG. 5, the strike plate 19 is fabricated from metal and is generally rectangular in configuration, approximately ⅜" thick, of sufficient width, generally approximately 1½", so that the longitudinal edge 26 of the strike plate when installed lies flush with the inner edge 27 of the lock jamb 6 as illustrated in FIG. 1. I have found that a 3½" length for the strike plate is a convenient length and provides sufficient strength to withstand even the most enthusiastic efforts to break in, particularly in view of the fact that the screw fasteners 21 are inclined approximately 60° with respect to the surface of the plate 19, and extend for approximately 3" into the vertical wall support members 10.

Figure 14:
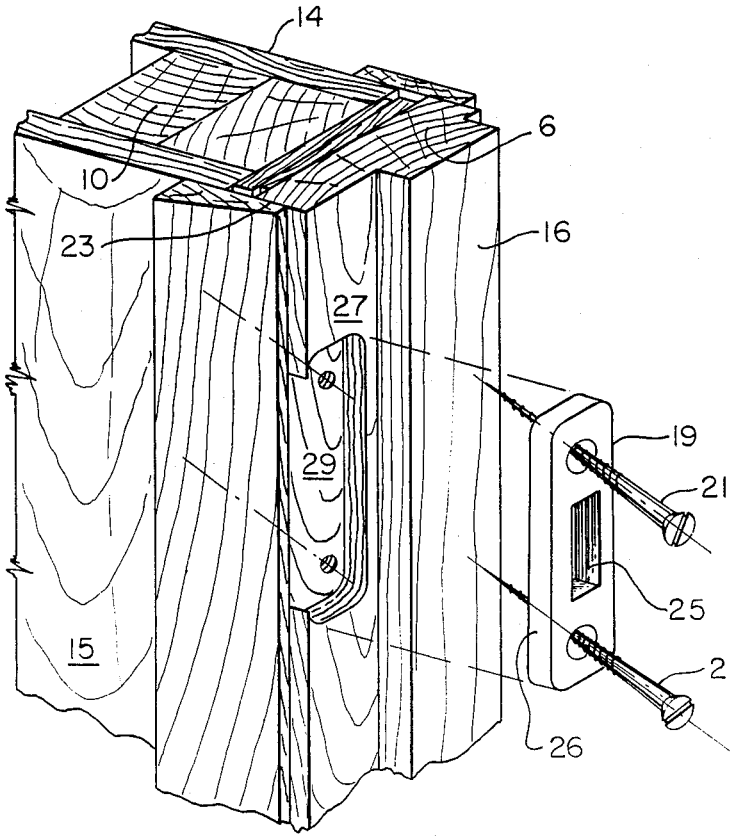
FIG. 14 is a perspective view in exploded form illustrating a portion of a wall support structure, a lock jamb, and the strike plate of FIG. 5 exploded from the assembly to illustrate the manner of installation and the angled relationship of the screw fasteners to the face of the strike plate.

In the embodiment of the strike plate illustrated in FIG. 11, the strike plate 19' is again approximately ⅜" thick, 3½" long, and the same width as the strike plate illustrated in FIG. 5. In this embodiment, the aperture 25' is provided with a lip 27 that projects inwardly of the aperture and forms a means by which an adjustment may be made to insure that the latch or bolt is received snugly in the aperture 25'. In like manner, the outer edge 26' is provided with an outwardly projecting flange or lip 28 having a beveled surface 29 formed thereon upon which the latch bolt may strike and which functions as a cam surface against the conventional inclined surface of the latch bolt as will hereinafter be explained to effect depression of the spring pressed latch or bolt and permit movement of the end of the latch bolt across the surface 23' of the strike plate. In all other respects, the strike plate 19' as illustrated in FIG. 11 is the same as the strike plate illustrated in FIG. 5. FIG. 14 illustrates in exploded view form, the recess 29 that is routed into the face of the lock jamb 6 to snugly accommodate the strike plate 19 (or 19') and the elongated screw fasteners 21.

Figure 2:
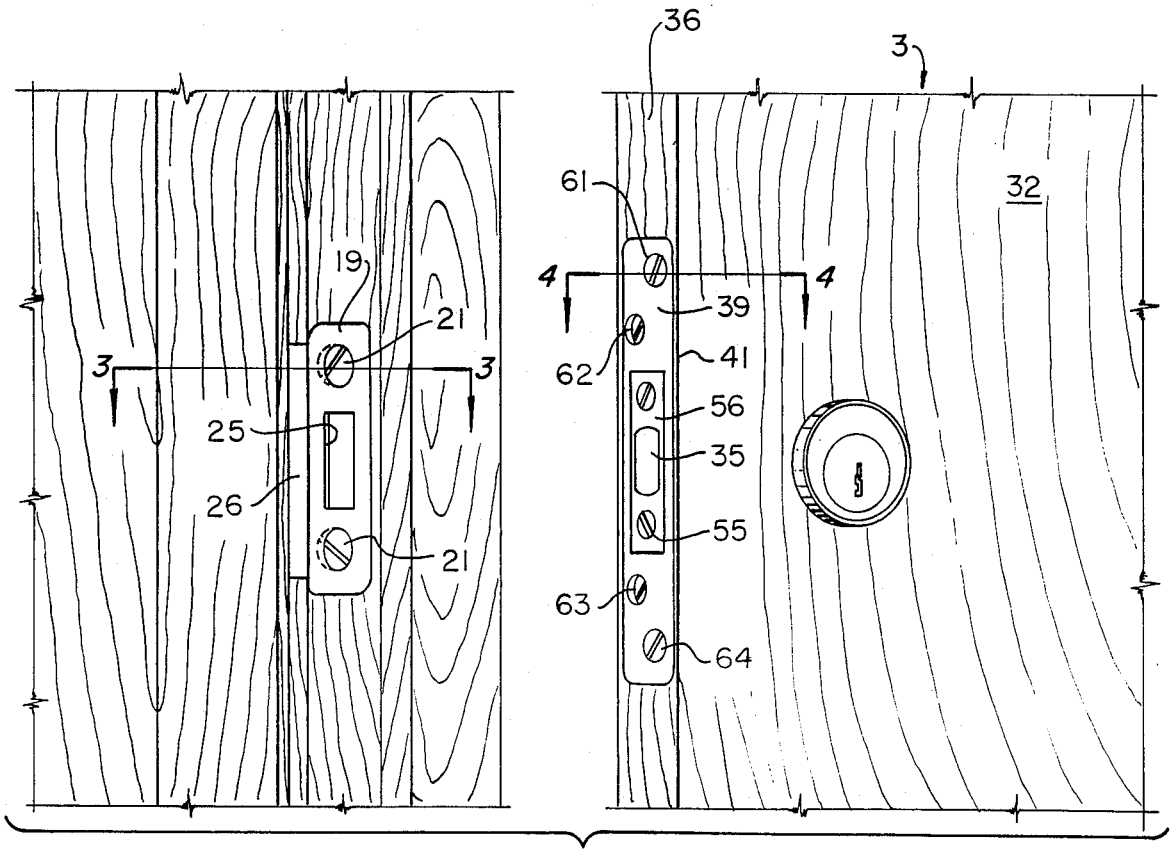
FIG. 2 is a fragmentary front elevational view showing the strike plate attached to the lock jamb and the reinforcement plate mortised into the door edge and on which the face plate is secured.
Figure 9:
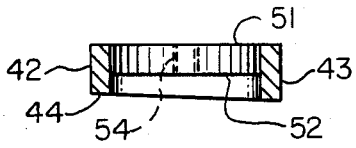
FIG. 9 is a horizontal sectional view taken in the plane indicated by the line 9—9 in FIG. 6.

Referring to FIG. 1, on the right hand side of the composite view, there is shown a door designated generally by the numeral 3, this being the door illustrated in FIG. 19 in the general door assembly. The door 3 as illustrated in FIGS. 1 and 2, is preferably a solid core door having an exterior surface 31 and an interior surface 32. Bored through the door is a transverse bore 33 adapted to receive a key lock assembly 34 which includes a bolt 35 which extends into the door from the lock edge 36 thereof in an appropriate bore 37 formed into the edge of the door in a manner to intersect the bore 33. The edge of the door 36 is mortised to provide a recess 38 within which may snugly nest the reinforcement plate 39 as illustrated in FIGS. 2, 4, 6, 9 and 10.

As illustrated in FIGS. 2 and 4, the plate 39, fabricated from metal, has a width less than the thickness of the door, so that when the recess 38 is formed in the edge of the door, and edge portion 41 of the door remains to cover the side edges 42 and 43 of the reinforcement plate. The plate 39 is preferably approximately ⅜" thick at its edge 43, and the front face 44 of the plate tapers from its thick edge 43 to the edge 42 which has a thickness of approximately 5/16". The reason for the taper on the front face 44 of the plate 39 is to accommodate the usual taper found on the lock edge of conventional doors, this taper being necessary to provide clearance to permit the door to pivot snugly against the lock jamb when the door is closed.

The plate 39 is preferably approximately 1⅜" wide, this width being approximately 24% of the length of the reinforcement plate, which preferably has a length of approximately 5¾". Formed in the face 44 of the plate 39 is a recess designated generally by the numeral 45, having end walls 46 and 47 and side walls 48 and 49 parallel to the side edges 42 and 43, respectively, of the plate. The recess 45 has a width approximately 73% of the width of the reinforcement plate, and a length that is approximately 41% of the length of the plate. Preferably, the recess 45 is symmetrically disposed in the surface 44 of the plate with respect to a plane 50 which is perpendicular to the rear surface 51 of the plate and which is medianly positioned between the lateral edges 42 and 43 as illustrated by the broken line in FIG. 6. The recess 45 has a depth of approximately ⅛ of an inch, as illustrated best in FIG. 9. The bottom 52 of the recess is formed with a centrally disposed aperture 53 adapted to accommodate the bolt 35. A pair of bores 54 in the bottom wall 52 are machine threaded so as to receive screw fasteners 55 that anchor the face plate 56 to the reinforcement plate within the recess 45.

In addition to the aperture 53 and the bores 54, the reinforcement plate 39 is also provided adjacent each opposite end with a plurality of bores for accommodating extraordinarily long screw fasteners to anchor the reinforcement plate in the recess 38 formed in the edge of the door. Referring to FIG. 6, it will there be seen that the plate 39 is provided adjacent its upper end with a pair of bores 57 and 58, the bore 57 being nearer the end of the reinforcement plate than the bore 58, and on the left side of the plane 50 while the bore 58 is on the right side of the plane 50 and nearer the recess 45. In like manner, referring to the lower end of the plate 39 as viewed in FIG. 6, the bores 59 and 60 adjacent this end of the reinforcement plate are symmetrically positioned with respect to the bores 57 and 58, the bore 59 being near the end edge of the reinforcement plate and being positioned on the left side of the plane 50, while the bore 60 is removed from the end edge and closer to the recess 45, and lying on the right side of the plane 50.

Figure 10:
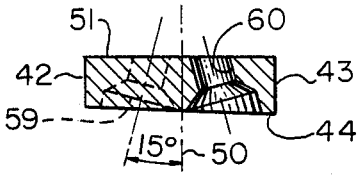
FIG. 10 is a horizontal sectional view taken in the plane indicated by the line 10—10 in FIG. 6.
Figure 12:
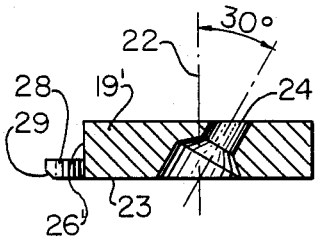
FIG. 12 is a horizontal sectional view taken in the plane indicated by the line 12—12 in FIG. 11.

It is important to note, as illustrated in FIGS. 1, 4, 6 and 10, that the bores 57–58 and 59–60 extend through the thickness of the reinforcement plate 39 at an angle other than 90°. Thus, the bores 57 and 58, referring to FIGS. 1 and 4, receive elongated screw fasteners 61 and 62, respectively, the screw fastener 61 penetrating the bore 57 at an angle of approximately 15° to the plane 50. The screw fastener 61 possesses a length of approximately 3", and penetrates deeply into the solid wood of the door 3 at a 15° angle so that the screw fastener actually crosses the median plane 50 extended through the door. In like manner, the screw fastener 62 penetrates the bore 58 on the right side of the plane 50 as viewed in FIG. 6, and is inclined at an angle of approximately 15° but in the opposite direction from the screw fastener 61. This screw fastener 62 also penetrates deeply into the solid wood of the door, crossing the extended median plane 50 through the door at a point below the corresponding median point at which the screw 61 crosses the median plane. In like manner, the screw fasteners 63 and 64 adapted to penetrate the bores 59 and 60, respectively, in the plate 39, penetrate the plate from opposite sides of the plane 50 at an angle of approximately 15° to the median plane, similar to the angles illustrated in FIG. 4 for the screw fasteners 61 and 62. FIG. 10 illustrates this relationship for the bores 59 and 60 and the extraordinarily long screw fasteners (not shown) adapted to pass therethrough and deeply into the wood of the door to thus reinforce the door against splitting.

It will thus be seen that in any attempt at a forced entry through a door equipped with a reinforcement plate such as discussed above, such forced entry will be resisted by the elongated screw fasteners 21 which anchor the thick metal strike plate 19 firmly in the recessed lock jamb 6, and will be resisted further by the elongated screw fasteners 61–62 and 63–64 which anchor the thick metal reinforcement plate 39 in the recess formed in the edge of the door. Thus, the strike plate 19 and reinforcement plate 39, because of their configurations and dimensions, cooperate with the elongated screw fasteners to resist any such force applied to gain unauthorized entry.

As discussed above, unauthorized entry into a premise is sometimes attempted by applying a destructive force to the door adjacent to the hinge connection of the door to the hinge jamb. The hinge jamb is usually fabricated from softwood, and the screws that hold the hinge to both the door and to the hinge jamb are frequently no longer than ¾" and frequently only ½". This, then, defines the third weak point in the security of the door assembly, and the means illustrated in FIGS. 15 through 18 reinforce this union between the door and the door frame to prevent, or make much more difficult, unauthorized forced entry through the door.

Figure 15:
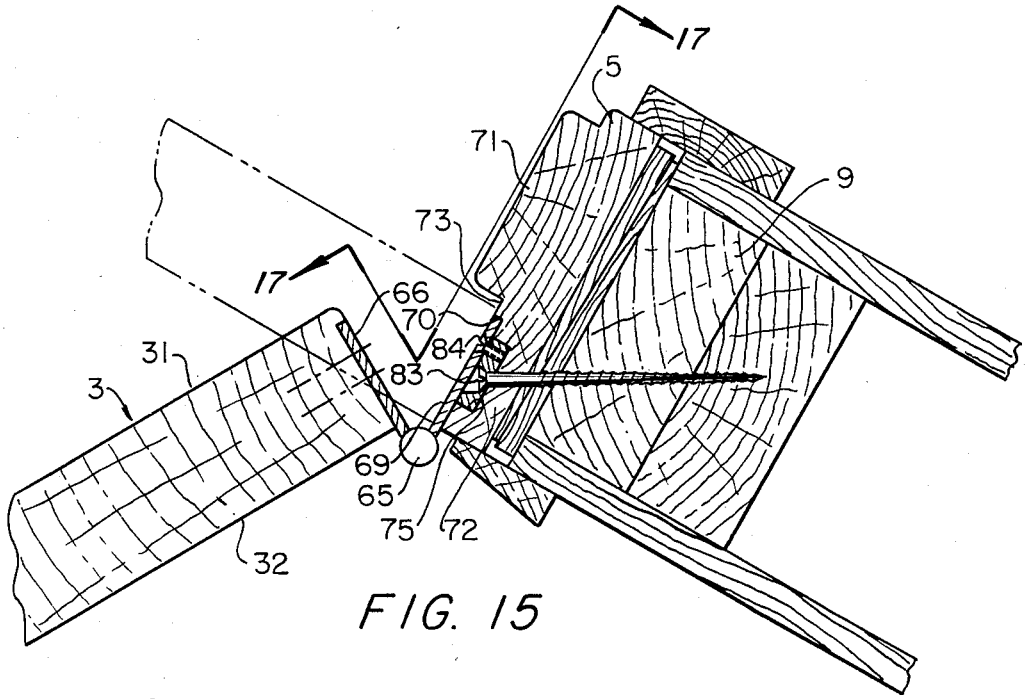
FIG. 15 is a fragmentary horizontal sectional view of a hinge portion of the assembly, illustrating the manner or reinforcement of the union between a hinge leaf and the associated hinge jamb and wall support members.

Referring to FIG. 15, it will there be seen that the door 3 is attached to the hinge jamb 5 by a hinge designated generally by the numeral 65. The hinge is provided with one leaf 66 that is attached by appropriate screw fasteners 67 to the hinge edge 68 of the door, while the other leaf 69 of the hinge fits into a recess 70 that is routed into the hinge jamb 5, the outer edge portion of the hinge jamb 5 having been rabbetted to provide a stop 71 and a thinned-down portion 72 within the face 73 of which the recess 70 is routed in a configuration and to a depth to snugly receive the hinge leaf 69 as illustrated.

The hinge leaf 69 is secured to the hinge jamb 5 within the recess 70 by screw fasteners 74 of conventional size and placement, it being noted that since the mortised recess 70 is formed in the thinned-down section 72 of the hinge jamb, if the hinge leaf 69 is secured only to this thinned-down portion of the hinge jamb only by the screws 74, it requires not much more than one or two strong kicks against the outer surface 31 of the door immediately adjacent the hinge to cause splitting and tearing away of the thinned-down portion 72 of the hinge jamb, thus giving access to the interior of the premises.

As stated above, it is one of the objects of the invention to reinforce this area of the door assembly to prevent such splitting or tearing away from occurring. To effect this purpose, there is provided in the bottom of the recess 70 a further recess 75 having a depth of approximately ⅜" and in this instance being circular in its configuration. It will of course be understood that any other appropriate configuration other than circular may be utilized. The recess 75 is adapted to snugly receive a reinforcement plate 76, best illustrated in FIGS. 17 and 18, the reinforcement plate 76 having a circular periphery 77, a front face 78 and a rear face 79. The plate may be formed of tough plastic, but metal is preferred.

Figure 17:
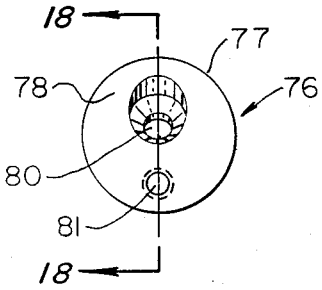
FIG. 17 is a front elevational view of the reinforcement plate inserted in the lock jab and underlying the hinge leaf.
Figure 18:
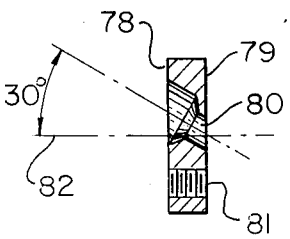
FIG. 18 is a vertical cross sectional view taken in the plane indicated by the line 18—18 in FIG. 17.

Formed in the reinforcement plate 76 are a pair of bores 80 and 81. Both of the bores are spaced along a common diameter of the circular reinforcement plate as illustrated in FIG. 17. The bore 80 is formed in the plate so that it passes through the thickness of the plate at an angle of approximately 30° to the central axis 82 of the plate. As illustrated in FIG. 18, the bore 80 is configured to correspond to the configuration of the head of a screw fastener 83.

The screw fastener 83, as illustrated in FIG. 15, passes at an angle through the reinforcement plate 76, passes also through the hinge jamb 5, and deeply into the vertical support members 9 to which the hinge jamb is secured. It will thus be seen that in order to effect dislodgement of the reinforcement plate 76 from the recess in which it is snugly nested, it is necessary that the force be so strong as to strip the elongated screw fastener 83 from the solidly anchored vertical support members 9. Because of the angle at which the screw is driven into the wall support members, any such force must impose tensile loads on the screw to strip it from the wood. Test have indicated that it takes much more than the force exerted by a strong kick, or even multiple kicks, to effect such a dislodgement of the screw 83 and reinforcement plate 76.

Figure 16:
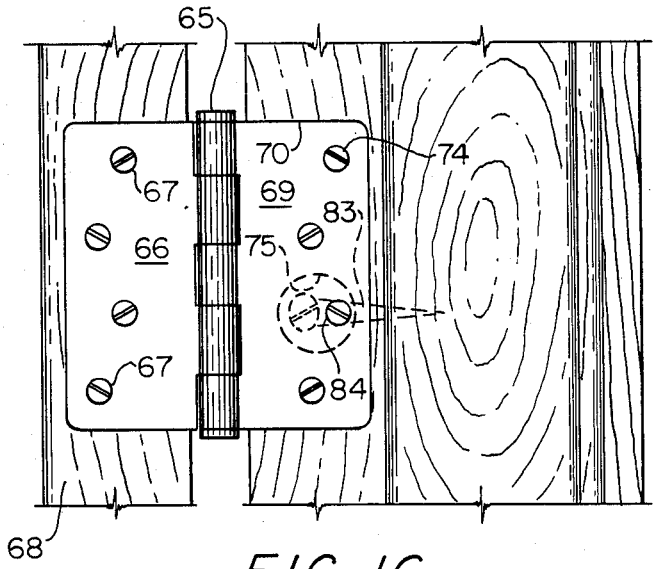
FIG. 16 is a front elevational view of the embodiment illustrated in FIG. 15.

The bore 81 formed in the reinforcement plate 76 is perpendicular to the face 78 and is machine-threaded to receive a machine-threaded screw fastener 84 as illustrated in FIG. 16. The screw fastener 84 securely fastens the hinge leaf 69 to the reinforcement plate 76, and thus cooperates with the screw fasteners 74 and the elongated screw fastener 83 to securely anchor the hinge leaf 69 to the associated wall structure.

From the foregoing, it will be apparent that the door assembly forming the subject matter of this invention has been totally reinforced by the application of individual reinforcement means at the weak points of the assembly which cooperate with each other and with the door with which they are associated to prevent an unauthorized forced entry through the door. Thus, the heavy duty strike plates illustrated in FIGS. 5 and 11 cooperate with the bolt structure illustrated in FIGS. 1 and 2, and the reinforcement plate 39 illustrated in FIG. 6, to materially strengthen the union of the door assembly and the wall structure in the area of the lock assembly. In like manner, the other weak point of the door assembly, namely, the hinge line of the door, has been reinforced by the reinforcement plate 76 illustrated in FIGS. 16 through 18, to thus eliminate the possibility that a would-be burglar, failing to rupture the lock assembly, will successfully turn his attention to the hinge line of the door and thus gain unauthorized entry into the premises.

Having thus described the invention, what is believed to be novel and sought to be protected by letters patent of the United States is as follows:

I claim:

1. As an article of manufacture, a door assembly constituting a closure for a passageway through a wall, the passageway being defined by vertical wall members, comprising:

(a) a door frame having a head, a hinge jamb and a lock jamb adapted to be anchored in a passageway;
(b) a door having a hinge stile and a lock stile including interior and exterior surfaces;
(c) a plurality of hinges operatively interposed between said hinge stile and said hinge jamb to pivotally support said door on said door frame;
(d) a lock assembly mounted on said lock stile and including an apertured face plate;
(e) a strike plate mounted on said lock jamb in operative association with said lock assembly;
(f) a strike plate recess formed in said lock jamb and a first pair of screw fasteners anchoring said strike plate in said strike plate recess, said screw fasteners passing through said strike plate and said lock jamb and into the vertical wall members of the passageway at an angle of other than 90° to the face of the strike plate;
(g) a recess formed in said lock stile in association with said face plate and having a depth, a width and a length greater than said face plate;
(h) a reinforcement plate having a width no greater than the thickness of said door nested snugly in said recess in said lock stile, said reinforcement plate having a planar front surface and having a rabbetted recess therein having a bottom wall displaced from said planar front surface, said bottom wall having an aperture which is aligned with the aperture in said face plate and a front surface of the face plate lying flush with the planar front surface of the reinforcement plate when said face plate is fitted snugly in said rabbetted recess;
(i) means including a second pair of screw fasteners with at least one screw fastener passing through said reinforcement plate adjacent each end and extending into said lock stile at an angle other than 90° to the planar front surface of said reinforcement plate and detachably securing said reinforcement plate to said lock stile within said recess; and
(j) a third pair of screw fasteners detachably securing said face plate to the bottom wall of said recess formed in said reinforcement plate and within said rabbetted recess whereby the apertures in said face plate and reinforcement plate are retained in alignment.

2. The combination according to claim 1, in which said screw fasteners are of sufficient length that at least two-thirds of their length extends into said vertical wall members.

3. The combination according in claim 1, in which an aperture is provided in said reinforcement plate centrally disposed in said recess, said face plate is provided with an aperture coaxially aligned with the aperture in the reinforcement plate when said face plate is nested in said recess, said lock assembly includes a bolt adapted to selectively project through the apertures in said reinforcement plate and said face plate, said strike plate being apertured and having a thickness of about three-eights of an inch, said aperture in said strike plate being coaxially aligned with the apertures in said reinforcement plate and said face plate, whereby when said bolt projects from said lock assembly in its door-locked condition said bolt projects through said reinforcement plate, said face plate and through said strike plate, said means detachably securing said reinforcement plate to said lock stile including two screw fasteners passing through said reinforcement plate adjacent each end and extending into said lock stile, one of said screw fasteners at each end extending into said lock stile at an oblique angle to said interior surface of the lock stile and the other screw fastener at each end extending into said lock stile at an acute angle to the interior surface of said lock stile, a pair of screw fasteners anchoring said strike plate to said lock jamb, said screw fasteners passing through said strike plate and said lock jamb and into said vertical wall members at an angle other than 90° to the face of the strike plate, said strike plate having a thickness of about three-eights of an inch and said screw fasteners anchoring said strike plate having a length about eight times the thickness of said strike plate, said reinforcement plate having a thickness substantially the same as said strike plate and the screw fasteners passing through said reinforcement plate having a length substantially the same as the screw fasteners that anchor the strike plate, said means for detachably securing said face plate to said reinforcement plate including a pair of machine screws.

4. As an article of manufacture, a door assembly constituting a closure for a passageway through a wall, said passageway being defined by vertical wall members, comprising:

(a) a door frame having a head, a hinge jamb and a lock jamb adapted to be anchored in a passageway;
(b) a door having a hinge stile and a lock stile including interior and exterior surfaces;
(c) a plurality of hinges operatively interposed between said hinge stile and said hinge jamb to pivotally support said door on said door frame;
(d) a lock assembly mounted on said lock stile and including an apertured face plate;
(e) a strike plate mounted on said lock jamb in operative association with said lock assembly;
(f) a recess formed in said lock stile in association with said face plate and having a depth, a width and a length greater than said face plate;
(g) a reinforcement plate having a width no greater than the thickness of said door nested snugly in said lock stile, said reinforcement plate having a planar front surface and having a rabbetted recess therein having a bottom wall displaced from said planar front surface, said bottom wall having an aperture aligned with the aperture in said face plate when said face plate is fitted snugly in said rabbetted recess whereby a front surface of the face plate lies flush with the planar front surface of the reinforcement plate;
(h) means detachably securing said reinforcement plate to said lock stile within said recess;
(i) means detachably securing said face plate to the bottom wall of said recess formed in said reinforcement plate and within said rabbetted recess whereby the apertures in said face plate and reinforcement plate are retained in alignment;
(j) a recess formed in said hinge jamb in association with at least one of said hinges and underlying the leaf of said hinge which is secured to said hinge jamb;
(k) a hinge reinforcement plate in said recess;
(l) means anchoring said hinge reinforcement plate in said recess in said hinge jamb, to said hinge jamb and to passageway vertical wall members underlying said hinge jamb when said door frame is anchored in a passageway; and
(m) means anchoring said hinge leaf to said hinge reinforcement plate and to said hinge jamb.

5. The combination according to claim 4, in which said hinge reinforcement plate is metal having a thickness of about three-eights of an inch.

6. The combination according to claim 4 in which said means for anchoring said hinge reinforcement plate in said hinge jamb comprises a screw fastener passing generally horizontally through said hinge reinforcement plate, through said hinge jamb and into the vertical wall members underlying said hinge jamb, and in which said means anchoring said associated hinge leaf to said hinge reinforcement plate comprises a screw fastener.

7. The combination according to claim 6, in which said screw fastener anchoring said hinge reinforcement plate to said hinge jamb passes generally horizontally through said reinforcement plate, through said hinge jamb and into the vertical wall members underlying said hinge jamb at an angle other than 90° to the face of said hinge jamb.

8. The combination according to claim 6, in which said screw fastener anchoring said associated hinge leaf to said hinge reinforcement place comprises a machine screw passing through said hinge leaf and into said hinge reinforcement plate at an angle of 90° to the hinge jamb.

9. The combination according to claim 5, in which said means for anchoring said hinge reinforcement plate in said hinge jamb is a screw fastener having a length of about eight times the thickness of said hinge reinforcement plate.

10. The combination according to claim 3, in which a recess is formed in said hinge jamb in association with at least one of said hinges and adapted to underlie the leaf of said hinge secured to said hinge jamb, a hinge reinforcement plate in said recess, a screw fastener anchoring said hinge reinforcement plate in said recess in said hinge jamb and to vertical wall members underlying said hinge jamb when said door frame is anchored in a passageway, and a screw fastener anchoring said hinge leaf to said hinge reinforcement plate anchored in said recess in said hinge jamb.

11. As an article of manufacture, a door assembly constituting a closure for a passageway through a wall, said passageway being defined by vertical wall members, comprising:

(a) a door frame having a head, a hinge jamb and a lock jamb adapted to be anchored in a passageway;
(b) a door having a hinge stile and a lock stile including interior and exterior surfaces;
(c) a plurality of hinges operatively interposed between said hinge stile and said hinge jamb to to pivotally support said door on said door frame;
(d) a lock assembly mounted on said lock stile and including an apertured face plate;
(e) a strike plate mounted on said lock jamb in operative association with said lock assembly;
(f) a recess formed in said lock stile in association with said face plate and having a depth, a width and a length greater than said face plate;
(g) a reinforcement plate having a width no greater than the thickness of said door nested snugly in said lock stile, said reinforcement plate having a planar front surface and having a rabbetted recess therein having a bottom wall displaced from said planar front surface, said bottom wall having an aperture aligned with the aperture in said face plate when said face plate is fitted snugly in said rabbetted recess whereby a front surface of the face plate lies flush with the planar front surface of the reinforcement plate;
(h) means detachably securing said reinforcement plate to said lock stile within said recess;
(i) means detachably securing said face plate to the bottom wall of said recess formed in said reinforcement plate and within said rabbetted recess whereby the apertures in said face plate and reinforcement plate are retained in alignment;

(j) a recess formed in said hinge jamb in association with at least one of said hinges and underlying the leaf of the associated hinge secured to said hinge jamb; and (k) hinge reinforcement means disposed in said recess in said hinge jamb and anchored to said associated hinge leaf, to said hinge jamb and to vertical wall members which underlie said hinge jamb when said door frame is anchored in a passageway.

12. The combination according to claim 11, in which said recess in said hinge jamb is circular, and said hinge reinforcement means comprises a circular plate.

13. The combination according to claim 11, in which at least three hinges are provided, one adjacent the top of the door and one adjacent the bottom of the door and one spaced intermediate the top and bottom hinges, and said hinge reinforcement means is disposed in association with said intermediate hinge.

14. The combination according to claim 12, in which hinge reinforcement means are associated with the top and bottom hinges.

* * * * *